US008713787B2

(12) United States Patent
Parelius

(10) Patent No.: US 8,713,787 B2
(45) Date of Patent: May 6, 2014

(54) FLAT FINISHER MAINTENANCE METHOD

(76) Inventor: Roger R. Parelius, McHenry, IL (US)

( * ) Notice: Subject to any disclaimer, the term of this patent is extended or adjusted under 35 U.S.C. 154(b) by 631 days.

(21) Appl. No.: 12/928,830

(22) Filed: Dec. 20, 2010

(65) Prior Publication Data

US 2012/0156318 A1 Jun. 21, 2012

(51) Int. Cl.
*E04F 21/06* (2006.01)
*B29C 31/02* (2006.01)

(52) U.S. Cl.
USPC ..... 29/592; 425/87; 81/486; 403/329; 401/5; 267/173

(58) Field of Classification Search
USPC ..... 29/592; 425/87; 81/486; 403/326, 329; 401/5, 171; 267/173
See application file for complete search history.

(56) References Cited

U.S. PATENT DOCUMENTS

| | | | |
|---|---|---|---|
| 3,116,511 | A | 1/1964 | Hoveland |
| 4,366,729 | A | 1/1983 | Strubing |
| 4,440,410 | A | 4/1984 | Bradshaw |
| 4,516,868 | A | 5/1985 | Molnar |
| 4,907,955 | A | 3/1990 | Snipes |
| 5,670,182 | A | 9/1997 | Mower |
| 2,809,513 | A | 10/1997 | Ames |
| 2,824,442 | A | 2/1998 | Ames |
| 5,902,451 | A | 5/1999 | O'Mara et al. |
| 6,146,039 | A | 11/2000 | Pool et al. |
| 6,371,465 | B1 | 4/2002 | Willis et al. |
| 6,869,492 | B1 | 3/2005 | Kooistra |
| 6,874,965 | B1 | 4/2005 | Mondloch et al. |
| 7,473,085 | B2 | 1/2009 | Schlecht |
| 2005/0100386 | A1 | 5/2005 | Murray |
| 2007/0259064 | A1 | 11/2007 | Mathews |
| 2010/0196078 | A1 | 8/2010 | Ovens |

*Primary Examiner* — Joseph S Del Sole
*Assistant Examiner* — Thukhanh Nguyen
(74) *Attorney, Agent, or Firm* — Meroni & Meroni, P.C.; Charles F. Meroni, Jr.; Christopher J. Scott

(57) ABSTRACT

A select spring coupler structure is outfitted upon a flat finisher assembly or apparatus so as to enhance the user's ability to maintain the flat finisher apparatus. The flat finisher apparatus essentially comprises at least one (tension) coil spring removably held in tension between opposing anchor structures. The select spring coupler structure according to the present invention is outfittable upon the coil spring at the first spring end of the coil spring. The spring coupler structure comprises certain radially extending structure for engaging the first spring end and certain finger engaging structure for enabling manual alteration (i.e. via one's digits) of spring tension so as to disengage the first spring end from respective anchoring structure. The spring coupler structure may be twisted into engagement with the first spring end(s) via the helical structure of adjacent loops of the coil spring to couple therewith.

14 Claims, 6 Drawing Sheets

FLAT FINISHER MAINTENANCE METHOD

BACKGROUND OF THE INVENTION

1. Field of the Invention

The present invention relates generally to a spring coupler structure for outfitting a (tension) coil spring. More particularly, the present invention relates to a spring coupler structure for outfitting a (tension) coil spring otherwise associated with a flat finisher apparatus so that user's thereof may more readily maintain the flat finisher apparatus.

2. Brief Description of the Prior Art

U.S. Pat. No. 4,366,729 ('729 Patent), which issued to Strubing, discloses a Coil Spring Extender Tool, and is being here cited to illustrate a tool designed specifically for extending a coil spring. In this regard, the '729 Patent describes a tool for extending a coil spring having at one end an end coil and at the other end a coil portion extending inwardly toward the longitudinal axis of said spring, said tool comprising a pair of level arms pivotally connected at one end and separated at the other ends to form a hand grip, characterized in a rod fixedly mounted at one end to one of said lever arms, said rod being dimensioned to slidably fit inside the coil of at least diameter of said spring to said coil portion, a first coaxial sleeve slidably fitted over said rod and pivotally connected at one end to an extension at said one end of the other of said lever arms, and a second coaxial sleeve slidably fitted over said rod and rotatably secured to said first sleeve at one end, said second sleeve having a finger at the other end adapted to capture said end coil of said spring when said rod is inserted inside said spring and said second sleeve is partially rotated, said spring being extended between the end of said rod and said finger as said lever arms are closed.

U.S. Pat. No. 6,146,039 ('039 Patent), which issued to Pool et al., discloses a Mud Box for Joint Compound Application. The '039 Patent describes a mud box having a bottom surface with an outlet orifice, sides, a cover pivotally attached along one edge, and a handle attached to the cover for positioning the box on a surface and applying extruding pressure to the cover for ejecting material through the orifice. A spring assembly is attached to the box and connected to apply extruding pressure to the cover.

A primary lock is coupled to the spring assembly and the box, the primary lock has a locked position in which the spring assembly is prevented from applying extruding pressure to the cover and an unlocked position in which the spring assembly applies extruding pressure to the cover. The primary lock is activated by a wheel assembly which moves it into the locked position when the box and wheel assembly are disengaged from a surface and which moves it into the unlocked position when the wheel assembly and box are engaged with a surface.

Perhaps most notably, the coil or tension springs described in the '039 Patent are outfitted at a first end thereof with so-called clips 43. The ends of tension springs 37 and 38, which are connected to front side 16 of box 11, are removably connected by means of clips 43. Each clip 43 comprises a central opening 44 which is slightly elongated and key-hole shaped to fit over the end of a bolt 45 threadedly engaged in the front end 16 of the box 11. Once a clip 43 is engaged over a bolt 45, the tension of the attached spring holds it firmly connected. The clips 43 are constructed to engage the ends of tension springs 37 and 38 and to be handily positioned over bolts 45 or removed therefrom. With the tension springs 37 and 38 disconnected, and the cover 20 open, the mud box 10 is ready for cleaning after a completed operation or for refilling.

U.S. Pat. No. 7,473,085 ('085 Patent), which issued to Schlecht, discloses Drywall Finishing Tool. The '085 Patent describes a drywall finisher's flat box having an adjustable pressure plate spring, independent suspension for guide wheels on the back plate, and a wiper configured so that the pressure plate can be pushed flat against the back plate, thus expelling nearly all of the drywall compound from the flat box. Note that the coil springs are anchored such that manual removal thereof is nearly impossible. This is the type of art that will support a patent application of the type we would recommend.

U.S. patent application Ser. No. 2005/0100386, which was authored by Murray, describes certain methods and apparatus for drywall tools that are high quality, durable, and in some case lightweight. For example, various tools may made by forming multiple sections into a single integrated piece by, for example, casting the parts using a molding process so as to reduce manufacturing cost and increase the structural durability of the tool. Further, various tools may be made, at least in part, using a material including magnesium to reduce the weight of the tool. Still further, various tools may be made using one or more protective coatings for protecting various metals against corrosion, for example, using a high impact coating such as paint covered with a clear coat of lacquer. None of the tools appear to disclose the spring inserts you have developed.

U.S. patent application Ser. No. 2007/0259064, which was authored by Mathews, teaches an improved flat finishing box, and specifically describes a guide device which is adapted to be removably attached to a flat box device for use in applying mastic adjacent an outside corner or edge. The guide device includes a generally S-shaped guide bar, a bracket, and a spring. The bracket is adapted to attach to the flat box device. The guide bar is pivotably and slidably retained by a first bracket portion. The spring is adapted to bias a first guide bar end of the guide bar away from the first bracket portion of the bracket.

The guide bar extends across a width of the flat box device and the first guide bar end extends below the flat box device when the guide device is operably installed on the flat box device. The spring biases the guide bar in a lateral direction corresponding to the width of the flat box device when the guide device is operably installed on the flat box device. Referencing FIG. No. 16, it will be seen that the coil springs appear to be post-mounted and thus would appear to be difficult to manually remove for cleaning/maintenance.

From a consideration of the foregoing, it will be noted that the prior art perceives a need for certain spring coupling means for enabling a flat finisher apparatus user to more easily/readily disengage coil springs from the apparatus for maintenance purposes. In this last regard, the prior art perceives a need for spring coupler structure(s) that function to both engage adjacent loops of a first end of the coil spring and enable the user to manually engage the unit for imparting force to the engaged adjacent loops of the first spring end so as to alter the tension in the spring and disengage the spring from structures designed to anchor and hold the spring in tension.

SUMMARY OF THE INVENTION

To achieve these and other readily apparent objectives, the present invention essentially discloses certain spring coupling means or fittings for (use with or) improving upon a flat finishing box assembly. The improved upon flat finishing box assembly, according to the present invention preferably comprises, in combination a flat finishing apparatus and at least one spring coupler structure or fitting. The flat finishing apparatus may essentially be a state of the art type flat finishing box or apparatus, but which essentially comprises at least one (tension) coil spring and certain tensioning means for maintaining the coil spring in tension.

The target flat finisher based coil spring comprises a first and second spring ends each of which comprise end-fixing loops. The loops are typically engaged with certain apparatus-based anchor structures for maintaining the coil spring in tension. The first spring end is selectively disengagable from the exemplified tensioning means for relaxing the coil spring and enabling the user to more readily maintain (e.g. clean) the flat finishing box or apparatus.

The select spring coupler structure according to the present invention is outfittable upon the coil spring at the first spring end. It is believed that the spring coupler structure preferably and essentially comprises certain radially extending structure for engaging the first spring end and certain finger engaging structure for enabling manual alteration (i.e. via one's digits) of spring tension.

Each of the select flat finisher spring coupler structures may be twisted or rotated about a twist axis into engagement with the first spring end(s) via the helical structure of adjacent loops of the coil spring. Each of the spring coupler structures further preferably comprises shaft insertion structure for insertion in an inner shaft of the coil spring. The shaft insertion structure extends substantially parallel relative to the axis of the coil spring when so outfitted, and is designed to help maintain the orientation of the finger-engaging structure relative to the first spring end.

BRIEF DESCRIPTION OF THE DRAWINGS

Other features of my invention will become more evident from a consideration of the following brief descriptions of patent drawings:

FIG. No. 1 is a plan view of a state of the art flat finisher apparatus showing laterally opposed coil springs held in tension.

Figure 1:
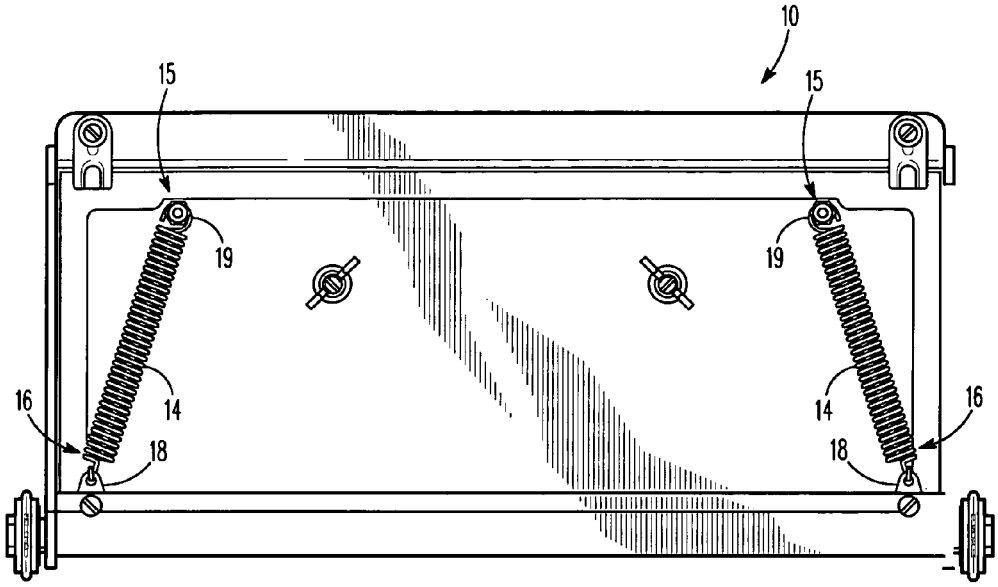
Figure 2:
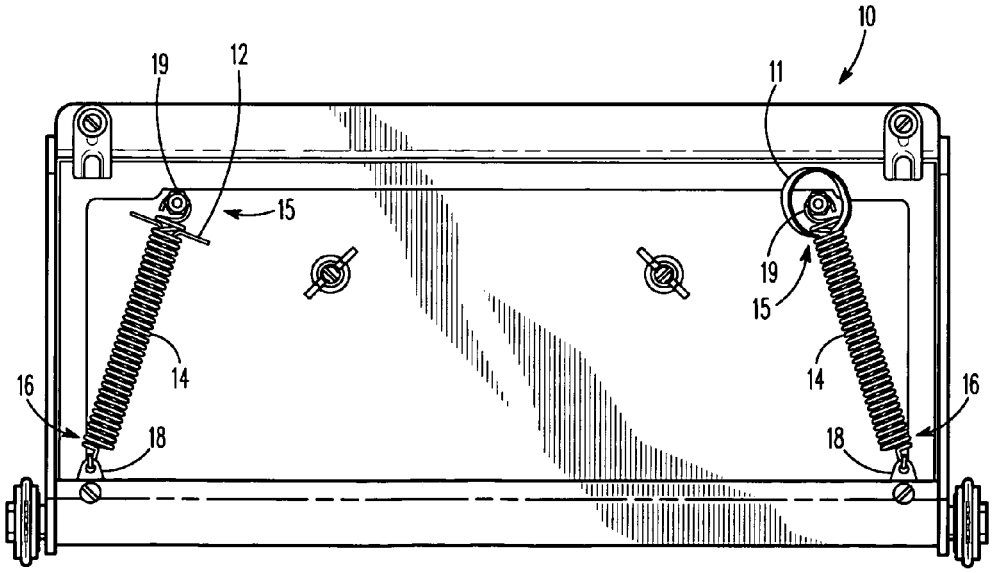
Figure 3:
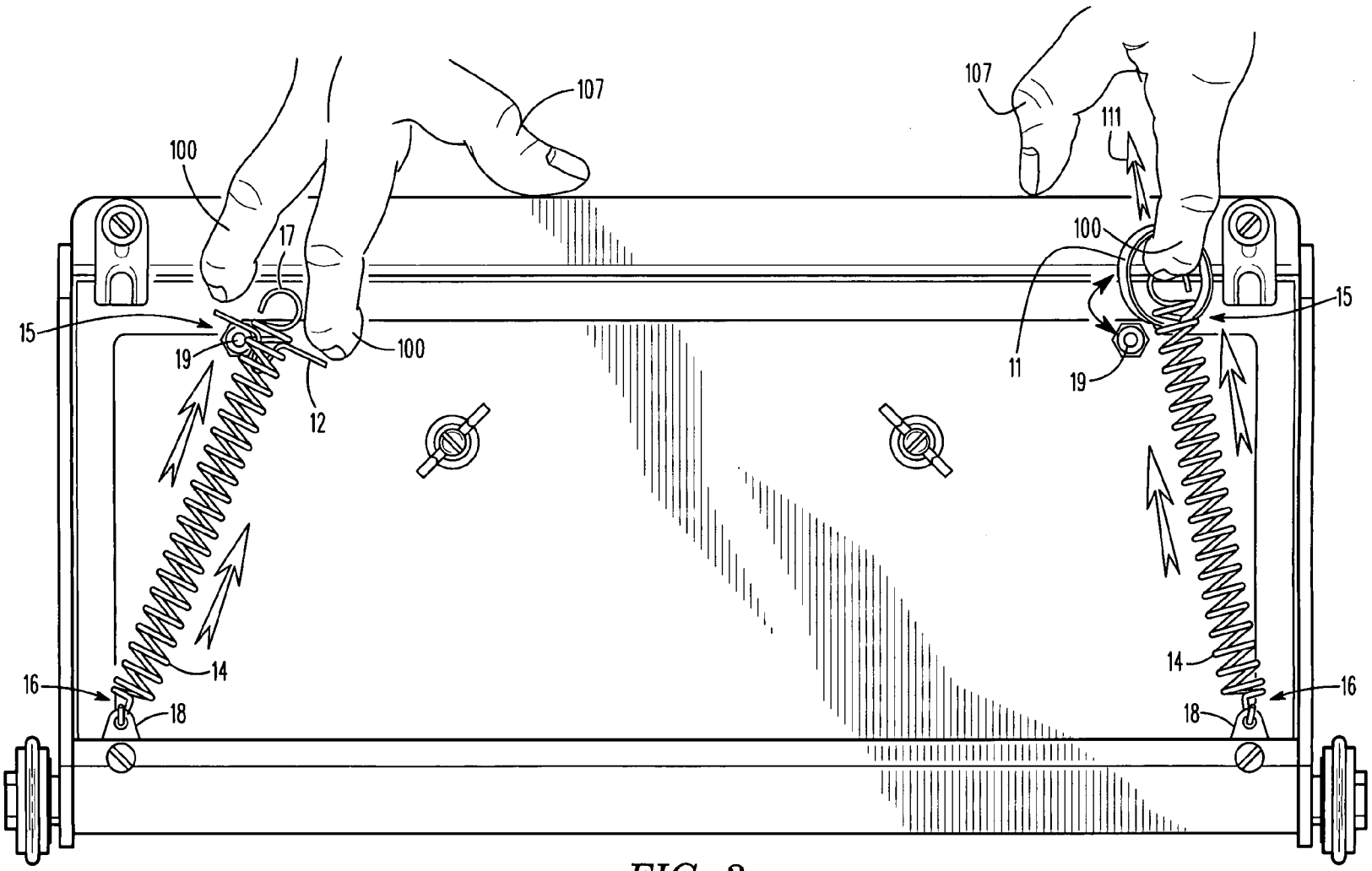
Figure 4A:
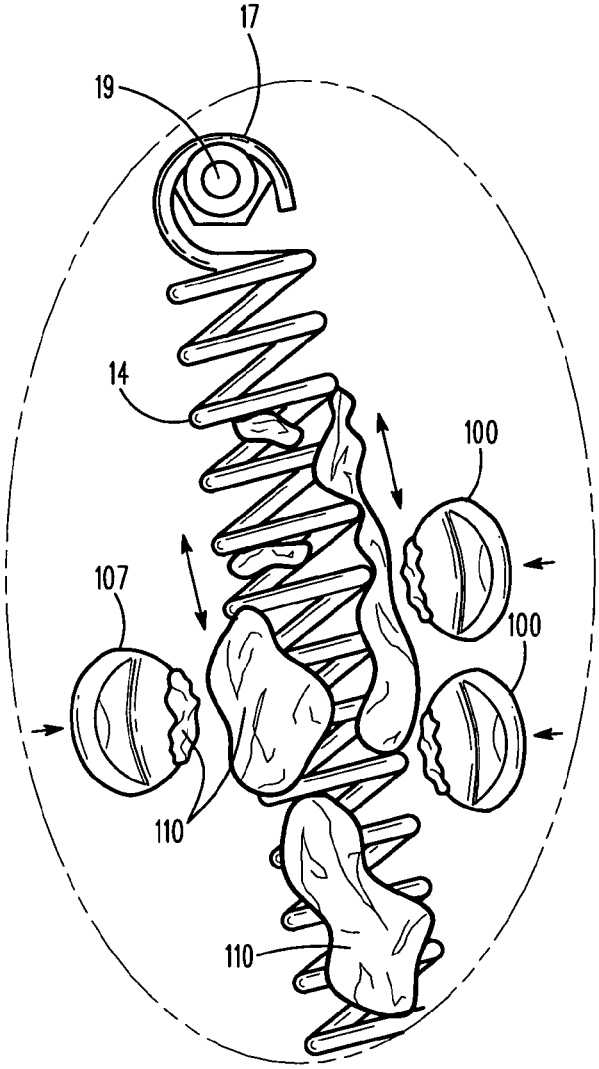
Figure 4:
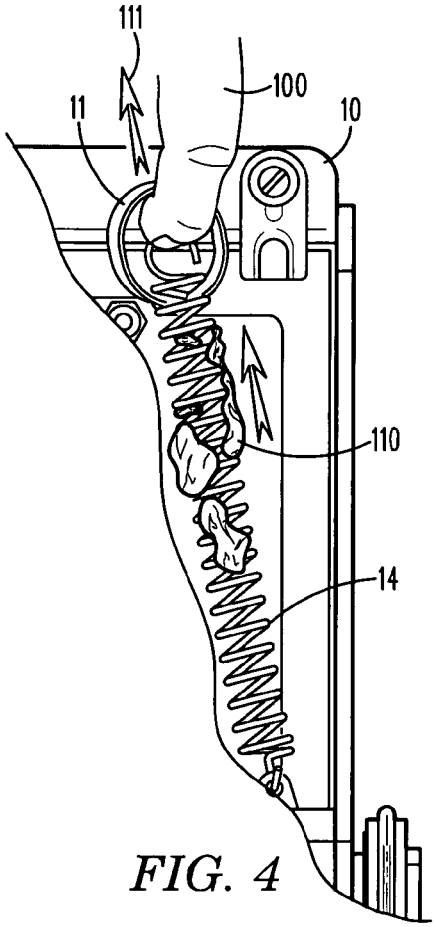
Figure 5:
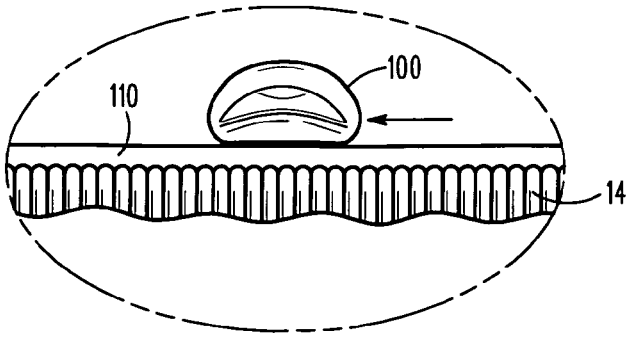
Figure 6:
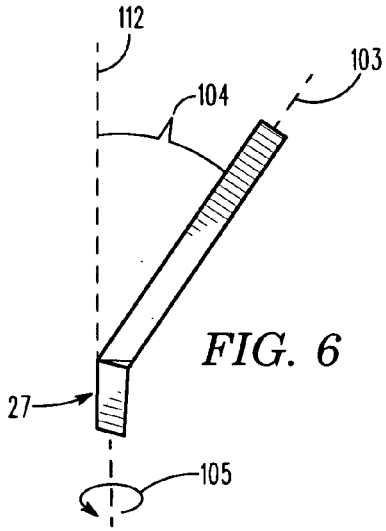
Figure 7:
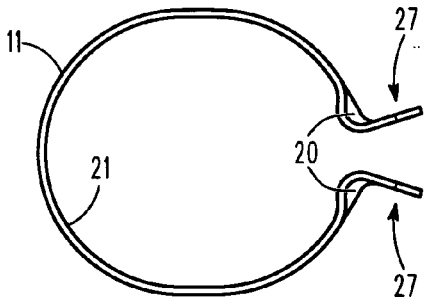
Figure 8:
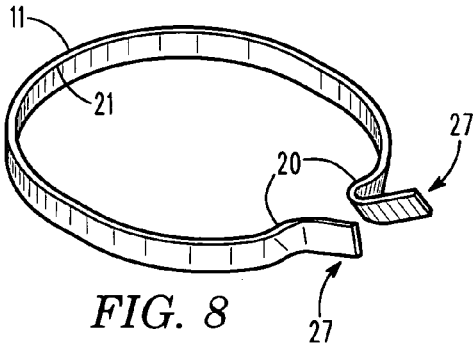
Figure 9A:
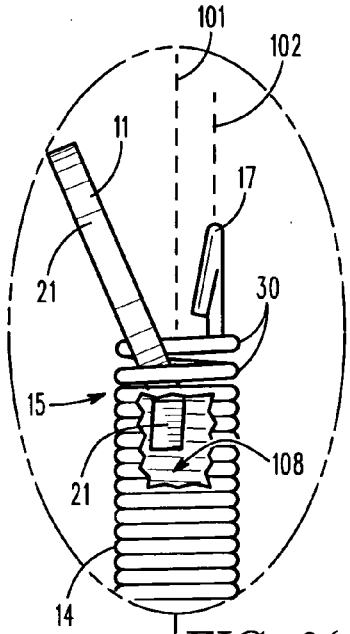
Figure 9:
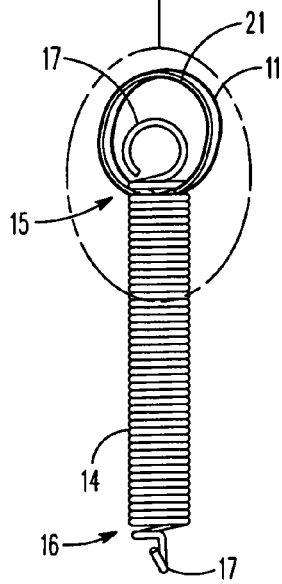
Figure 10:
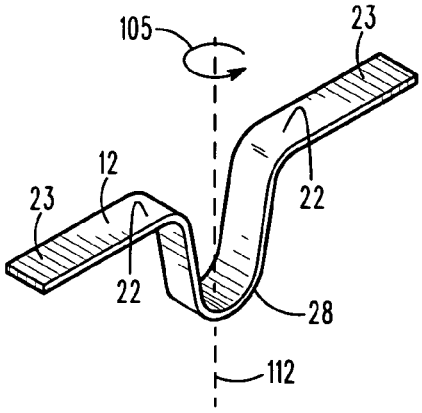
Figure 11:
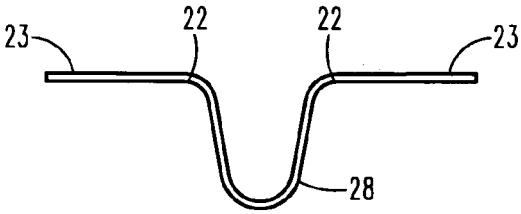
Figure 12:
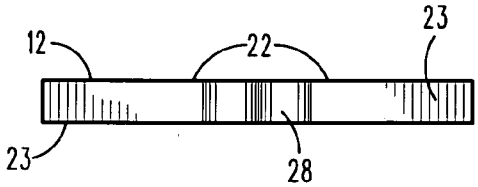
Figure 13A:
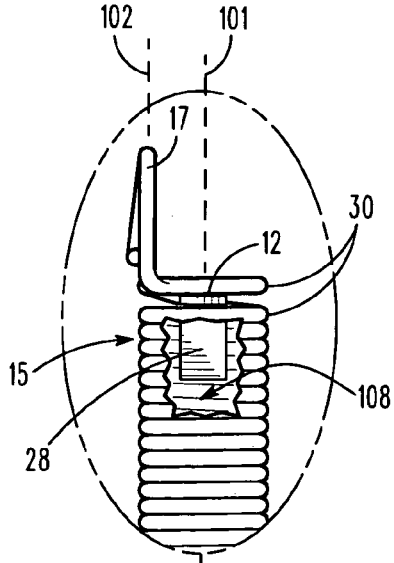
Figure 13:
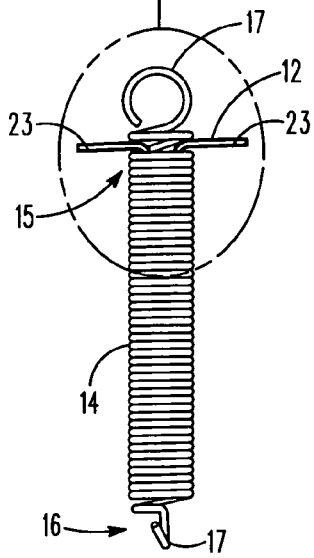
Figure 14:
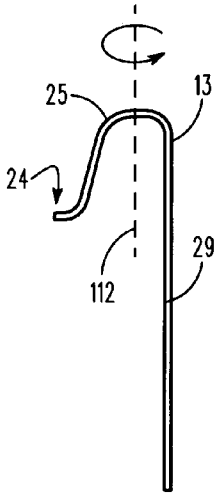
Figure 15:
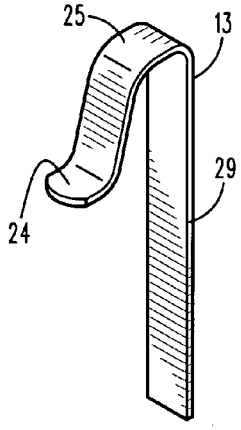
Figure 19A:
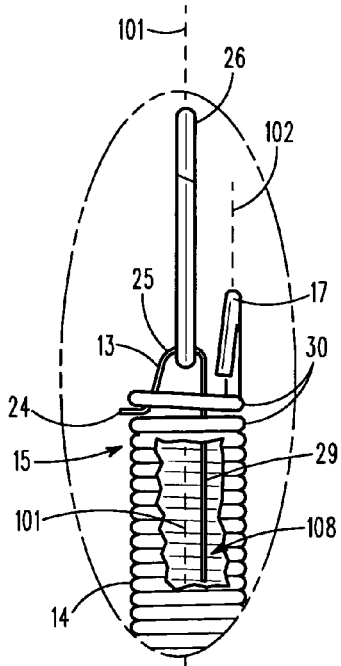
Figure 16:
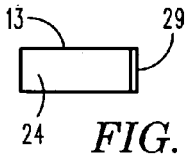
Figure 17:
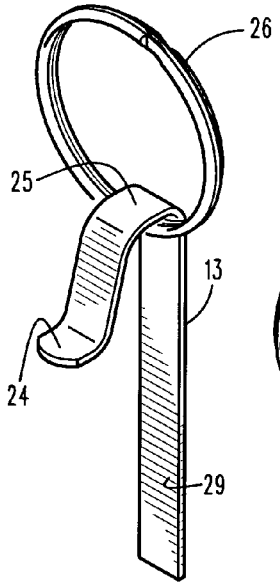
Figure 18:
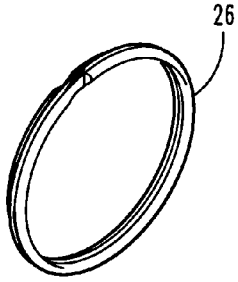
Figure 19:
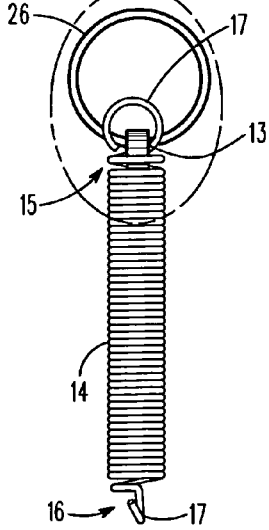

FIG. No. 2 is a plan view of the state of the art flat finisher apparatus otherwise depicted in FIG. No. 1 showing the laterally opposed coil springs held in tension with first and second spring coupler structures outfitted therewith.

FIG. No. 3 is an enlarged plan view of the state of the art flat finisher apparatus otherwise depicted in FIG. No. 2 showing users manually engaging the laterally opposed coil springs via the first and second spring coupler structures outfitted therewith for altering tension in the springs for removing them from the tensioning means.

FIG. No. 4 is a fragmentary enlarged view of the right most sections of the flat finisher apparatus otherwise depicted in FIG. No. 3 showing a user's finger manually engaging the right most coil spring via the spring coupler, which spring body has lubricating material located thereon.

FIG. No. 4(*a*) is a fragmentary enlarged view of a coil spring held in tension with lubricating material coating portions of the spring body, which spring body is structurally situated intermediate (end views of) a user's digits with lubricating material coating portions of the spring-engaging surface of the digits.

FIG. No. 5 is a diagrammatic depiction of (an end view of) a user's finger contacting a lubricating material as coated upon a spring body for demonstrating decreased friction intermediate the finger and spring body via the lubricating material.

FIG. No. 6 is a side view of a first alternative embodiment of spring coupler structure according to the present invention depicting a twist axis and a first loop plane in broken lines.

FIG. No. 7 is a frontal view of the first alternative embodiment of spring coupler structure otherwise depicted in FIG. No. 6.

FIG. No. 8 is a frontal perspective view of the first alternative embodiment of spring coupler structure otherwise depicted in FIG. Nos. 6 and 7.

FIG. No. 9 is a frontal elevational view of a coil spring outfitted with the first alternative embodiment of the spring coupler structure.

FIG. No. 9(*a*) is a fragmentary enlarged sectional side view of the first spring end as outfitted with the first alternative embodiment of the spring coupler structure as sectioned from FIG. No. 9, and with parts of the spring body broken away to show otherwise hidden structure.

FIG. No. 10 is a top perspective view of a second alternative embodiment of spring coupler structure according to the present invention depicting a twist axis extending therethrough.

FIG. No. 11 is a side view of the second alternative embodiment of spring coupler structure otherwise depicted in FIG. No. 10.

FIG. No. 12 is a top plan view of the second alternative embodiment of spring coupler structure otherwise depicted in FIG. Nos. 10 and 11.

FIG. No. 13 is a frontal elevational view of a coil spring outfitted with the second alternative embodiment of the spring coupler structure.

FIG. No. 13(*a*) is a fragmentary enlarged sectional side view of the first spring end as outfitted with the second alternative embodiment of the spring coupler structure as sectioned from FIG. No. 13, and with parts of the spring body broken away to show otherwise hidden structure of the spring coupler structure.

FIG. No. 14 is a side elevational view of a third alternative embodiment of spring coupler structure according to the present invention depicting a twist axis extending therethrough.

FIG. No. 15 is a first top perspective view of the third alternative embodiment of spring coupler structure otherwise depicted in FIG. No. 14.

FIG. No. 16 is a bottom plan view of the third alternative embodiment of spring coupler structure otherwise depicted in FIG. Nos. 14 and 15.

FIG. No. 17 is a second top perspective view of the third alternative embodiment of spring coupler structure outfitted with a key ring.

FIG. No. 18 is a second top perspective view of the key ring otherwise depicted in FIG. No. 17.

FIG. No. 19 is a frontal elevational view of a coil spring outfitted with the third alternative embodiment of the spring coupler structure.

FIG. No. 19(*a*) is a fragmentary enlarged sectional side view of the first spring end as outfitted with the second alternative embodiment of the spring coupler structure as sectioned from FIG. No. 19, and with parts of the spring body broken away to show otherwise hidden structure of the spring coupler structure.

DETAILED DESCRIPTION OF THE PREFERRED EMBODIMENT AND METHODOLOGY

Referring now to the drawings with more specificity, the preferred embodiment of the present invention concerns a spring coupler or fitting for use with or improving a state of the art flat finishing box assembly 10 as generally depicted in FIG. Nos. 1-3. The improved upon flat finishing box assembly, according to the present invention preferably comprises, in combination a flat finishing apparatus 10 and at least one spring coupler structure or fitting as variously depicted at 11, 12, and 13. The flat finishing apparatus 10 may essentially be a state of the art type flat finishing box or apparatus, but which essentially comprises at least one (tension) coil spring 14 and certain tensioning means for maintaining the coil spring 14 in tension.

In this last regard, as in most flat finishing box or apparatus constructions, the coil spring 14 comprises a first spring end 15 and a second spring end 16, which ends 15 and 16 each comprise end-fixing loops as at 17, which loops 17 are engaged with certain apparatus-based anchor structures for maintaining the coil spring 14 in tension. For example, as is relatively common in the art, the end-fixing loops 17 may be anchored at the second spring ends 16 to a (flange- or wall-based) apertured structure 18, and the end fixing loops 17 at the first spring ends 15 may be (removably) anchored at an end-fixing post 19. The end-fixing loop 17 at the first spring end 15 receives the post 19 after a certain tension has been imparted to the coil spring 14 such that the structure 18 and the post 19 maintain the coil spring 14 in tension.

As indicated, the coil spring 14 comprises first and second spring ends 15 and 16. The first spring end 15 is selectively disengagable from the exemplified tensioning means for relaxing the coil spring 14 and enabling the user to more readily maintain (e.g. clean) the flat finishing box or apparatus 10.

The select spring coupler structure according to the present invention is outfittable upon the coil spring 14 at the first spring end 15. Whether the spring coupler structure is defined by structure 11, 12, or 13, it is believed that the spring coupler structure preferably and essentially comprises radially extending structure for engaging the first spring end 15 and finger engaging structure for enabling manual alteration of spring tension as generally depicted in FIG. Nos. 3 and 4.

The radially extending structure of spring coupler structure 11 is referenced at 20 in FIG. Nos. 7 and 8. It will be noted that the spring coupler structure 11 preferably comprises opposed radially extending structures 20 for engaging radially opposed coil portions of the first spring end 15. The opposed radially extending structures 20 of spring coupler structure 11 extend in an arcuate manner to form a loop or ring structure as at 21. In other words, the opposed radially extending structures 20 are opposed portions of a ring structure 21 for enabling the user to manually (i.e. via one's digits 100/107) alter spring tension in the coil spring 14.

It may be seen and recalled from a comparative inspection of the various figures that the coil spring 14 may comprise an end-fixing loop as at 17. Notably, the end-fixing loop of the first spring end 15 extends in a first loop plane 102, and that the loop or ring structure 21 extends in a second loop plane 103. The first and second loop planes preferably and generally extend in differing planes, but preferably extend obliquely from one another (e.g. at a 30° angle 104) for directing both axial and radial force components into the first spring end 15 so as to enhance the user's ability to manually alter spring tension by distancing the user's finger from the loop 17.

The finger-engaging or ring or loop structure 21 of spring coupler structure 11 is referenced at 21 in FIG. Nos. 6-9(*a*). When the spring coupler structure 11 is outfitted upon the first spring end 15 of coil spring 14, the spring coupler structure 11 thereby enables the user to selectively and manually direct force 111 into the coil spring 14 so as to disengage the coil spring 14 from the tensioning means as generally depicted in FIG. Nos. 3 and 4.

The radially extending structure of spring coupler structure 12 is referenced at 22 in FIG. Nos. 10-12. The finger-engaging structure of spring coupler structure 11 is referenced at 23 in FIG. Nos. 6-9(*a*). It will be noted that the spring coupler structure 12 preferably comprises opposed radially extending structures 22 for engaging radially opposed coil portions of the first spring end 15.

The opposed radially extending structures 22 of spring coupler structure 12 essentially define the finger-engaging structure(s) 23. When the spring coupler structure 12 is outfitted upon the first spring end 15 of coil spring 14, the spring coupler structure 12 thereby enables the user to selectively and manually direct force into the coil spring 14 so as to disengage the coil spring 14 from the tensioning means as generally depicted in FIG. No. 3. The radially extending structure of spring coupler structure 13 is referenced at 24 in FIG. Nos. 14-17, and 19(*a*). The finger-engaging structure of spring coupler structure 13 is referenced at 25 in FIG. Nos. 14, 15, 17, and 19(*a*). When the spring coupler structure 13 is outfitted upon the first spring end 15 of coil spring 14, the spring coupler structure 13 thereby enables the user to selectively and manually direct force into the coil spring 14 so as to disengage the coil spring 14 from the tensioning means.

Preferably, however, the height of finger-engaging structure is abbreviated relative to a typical user finger 100. To accommodate a user finger, it is contemplated that a ring structure 26 (akin to structure 21) may be coupled to the structure 25 to enhance the user's ability to selectively and manually direct force into the coil spring 14.

In other words, the finger engaging structure 25 is preferably defined by a loop structure extending from the radially extending structure for coupling with secondary coupling means (e.g. ring structure 26) for manually for enabling the user to manually alter spring tension. Other objects, such as (branded) pull tabs and the like (not specifically illustrated) may be attached/linked to the ring structure 26 (or the loop structure 21 of spring coupler structure 11) so as to enable the user to ornament or brand-identify the spring coupler construction.

Each of the flat finisher spring coupler structures 11, 12, and 13 may be twisted or rotated about a twist axis 112 (as depicted and referenced at rotation arrow 105) into engagement with the first spring end(s) 15 via the helical structure of adjacent loops 27 of the coil spring 14. Each of the spring coupler structures 11, 12, and 13 further preferably comprise shaft insertion structure for insertion in an inner shaft 108 of the coil spring 14. The shaft insertion structure extends substantially parallel relative to the axis 101 of the coil spring 14 when so outfitted, and is designed to help maintain the orientation of the finger-engaging structure relative to the first spring end 15.

In other words, it is believed that the shaft insertion structure helps maintain the axial alignment of coupler structure relative to the axis 101. The shaft insertion structure of spring coupler structure 11 is referenced at 27 in FIG. No. 6-8, and 9(*a*); the shaft insertion structure of spring coupler structure 12 is referenced at 28 in FIG. No. 10-12, and 13(*a*); shaft insertion structure of spring coupler structure 13 is referenced at 29 in FIG. No. 14-17, and 19(*a*).

While the foregoing specifications set forth much specificity, the same should not be construed as setting forth limits to the invention but rather as setting forth certain preferred embodiments and features. For example, as prefaced hereinabove, it is contemplated that the present invention essentially provides a flat finisher spring coupler structure (as variously exemplified and referenced at 11, 12, and 13), which flat finisher spring coupler structure is outfittable upon a flat-finisher based coil spring as at 14.

The spring coupler comprises certain radially extending structure and certain primary coupling means for enabling a user to alter tension in the coil spring when outfitted upon said spring. The radially extending structure, as variously described, is (twist-) inserted intermediate adjacent loops 30 of the coil spring 14. The radially extending structure extends substantially radially relative to a spring axis as at 101 of the coil spring 14 when outfitted upon said spring 14. The primary means for enabling a user to manually alter tension in the coil spring when outfitted upon said spring is exemplified by finger-engaging structures variously described.

It will be recalled that U.S. Pat. No. 6,149,039, which issued to Pool et al. (the '039 Patent) describes certain structures for engaging first ends of coil springs used in combination with the mud box of the '039 Patent. The coil or tension springs described in the '039 Patent are outfitted at first ends thereof with so-called clips as referenced at 43. The ends of tension springs 37 and 38 have end-anchoring loops that extend in a plane in which the coil axis is also situated.

Each Pool et al. clip 43 comprises a central opening 44 which is slightly elongated and key-hole shaped to fit over the end of a bolt 45 threadedly engaged in the front end 16 of the box 11. Each clip further comprises a loop-receiving, apertured-anchor structure of the Pool et al. arm 28. This aperture arm 28 received an end-anchoring loop, which loop comprises the coil axis or is substantially parallel thereto. Once a clip 43 is engaged over a bolt 45 by receiving the bolt 45 through the key-hole shaped aperture, the tension of the attached spring holds it firmly connected.

In structural distinction thereto, however, the spring coupler structures 11, 12, and 13 according to the present invention are structurally engaged with the first spring ends 15 of coil springs 14 such that radially extending structure (as at 20, 22, and 24) engages (i.e. is sandwiched) between adjacent (parallel) loops as at 30 of the coil body, which loops are orthogonal to the coil axis 101.

It is thus believed that since all coil springs will necessarily have adjacent loops (as generally referenced at 30 at first ends of the coil body), the spring coupler structures 11, 12, and 13 may outfit a wide variety of coil springs, whereas the Pool et al. clip 43 appears to be somewhat limited in utility for use with the springs of the type referenced at 38 in the '039 Patent having end-anchoring loops extending in planes comprising or parallel to the coil axis.

In addition to the foregoing structural considerations, it is further believed that the inventive concepts discussed support certain new methodologies and/or processes. In this regard, it is contemplated that the foregoing structures support a flat finisher maintenance method comprising the step of initially outfitting a flat-finisher based coil spring 14 with a spring coupler as variously described and referenced at 11, 12, and 13. The first and second spring ends 15 and 16 of the coil spring 14 may be fixed via certain spring tensioning means as variously exemplified and described so as to place the coil spring 14 into a state of tension.

The tension in the coil spring 14 may thereafter be altered via the select spring coupler so as to disengage the first spring end 15 from the tensioning means. The coil spring 14 may then be relaxed via the removed first spring end 15, and the flat finisher-based coil spring may thereafter be more properly maintained. In this regard, the reader will take note that various lubricating materials (as generally depicted and referenced at 110 in FIG. Nos. 4-5) (such as finishing plaster or mud applied by the flat finisher apparatus or water) may either coat the coil spring 14 or a user's fingers 100 or thumb(s) 107 and thus reduce friction intermediate the user's digits 100/107 and spring 14.

Referencing FIG. No. 5, it will be seen that when lubrication or a lubricating material 110 is structurally situated or interposed intermediate the coil spring 14 and one's digits such as a finger 100 the friction intermediate the opposing structures is reduced thereby making it more difficult to grab or otherwise manually manipulate the coil spring 24 with one's digits 100/107. The spring couplers 11, 12, and/or 13, when outfitted upon the coil spring 14 thus enable the user to more readily alter spring tension so as to maintain the spring (s) 14 and flat finishing apparatus 10.

The step of outfitting the flat-finisher based coil spring 14 with a spring coupler may be said to preferably comprise the step of twisting 105 the select spring coupler into adjacent loops 27 of the coil spring 14. The step of altering tension in the coil spring may be said to comprise the step of directing force into radially opposed coil portions via the opposed radially extending structures. The step of altering tension in the coil spring 14 may also be said to comprise the step of obliquely directing force (i.e. force comprising both axial and radial force components) into radially opposed coil portions. The step of altering tension in said coil spring 14 may also be achieved by way of the spring coupler so as to initially or repeatedly engage the first spring end 15 with the tensioning means.

Accordingly, although the invention has been described by reference to certain preferred embodiments and certain methodologies, it is not intended that the novel arrangement and methods be limited thereby, but that modifications thereof are intended to be included as falling within the broad scope and spirit of the foregoing disclosures and the appended drawings.

I claim:

1. A flat finisher maintenance method, the maintenance method comprising the steps of:

outfitting a flat-finisher-based coil spring with a spring coupler, the spring coupler comprising:

radially extending structure for insertion intermediate adjacent loops of the flat-finisher-based coil spring, the radially extending structure extending substantially radially relative to a spring axis of the flat-finisher-based coil spring when outfitted upon said flat-finisher-based coil spring; and primary coupling means for enabling a user to manually alter tension in the flat-finisher-based coil spring when outfitted upon said flat-finisher-based coil spring;

tensioning the flat-finisher-based coil spring, the flat-finisher-based coil spring being tensioned by fixing first and second spring ends of said flat-finisher-based coil spring via spring tensioning means;

altering tension in said flat-finisher-based coil spring via the spring coupler so as to disengage the first spring end from the spring tensioning means;

relaxing the flat-finisher-based coil spring via the removed first spring end; and maintaining the flat-finisher-based coil spring.

2. The maintenance method of claim 1 wherein the step of outfitting the flat-finisher-based coil spring with a spring coupler comprises the step of twisting the spring coupler into adjacent coils of said flat-finisher-based coil spring.

3. The maintenance method of claim 1 wherein the step of altering tension in said flat-finisher-based coil spring comprises the step of directing force into radially opposed coil portions.

4. The maintenance method of claim 3 wherein the step of altering tension in said flat-finisher-based coil spring comprises the step of obliquely directing force into radially opposed coil portions.

5. The maintenance method of claim 1 comprising the step of altering tension in said flat-finisher-based coil spring via the spring coupler so as to engage the first spring end with the spring tensioning means.

6. A flat finisher maintenance method, the maintenance method comprising the steps of:

outfitting a coil spring with a spring coupler, the coil spring being flat finisher based, the spring coupler comprising:

radially extending structure for insertion intermediate adjacent loops of the coil spring, the radially extending structure extending substantially radially relative to a spring axis of the coil spring when outfitted upon said coil spring; and primary coupling means for enabling a user to manually alter tension in the coil spring when outfitted upon said coil spring;

fixing first and second spring ends of said coil spring via spring tensioning means so as to tension said coil spring;

altering tension in said coil spring via the spring coupler so as to disengage the first spring end from the spring tensioning means;

relaxing the coil spring via the removed first spring end; and maintaining the coil spring.

7. The maintenance method of claim 6 wherein the step of outfitting the coil spring with a spring coupler comprises the step of twisting the spring coupler into adjacent coils of said coil spring.

8. The maintenance method of claim 6 wherein the step of altering tension in said coil spring comprises the step of directing force into radially opposed coil portions.

9. The maintenance method of claim 8 wherein the step of altering tension in said coil spring comprises the step of obliquely directing force into radially opposed coil portions.

10. The maintenance method of claim 6 comprising the step of altering tension in said coil spring via the spring coupler so as to engage the first spring end with the spring tensioning means.

11. A flat finisher assembly maintenance method for maintaining elements of a flat finisher assembly, the maintenance method comprising the steps of:

outfitting a flat-finisher-based coil spring with a spring coupler, the spring coupler comprising:

radially extending structure for insertion intermediate adjacent loops of the coil spring, the radially extending structure extending substantially radially relative to a spring axis of the coil spring when outfitted upon said coil spring; and primary coupling means for enabling a user to manually alter tension in the coil spring when outfitted upon said coil spring;

tensioning the outfitted coil spring upon a flat finisher via the spring coupler;

relaxing the outfitted coil spring via the spring coupler; and maintaining the relaxed, outfitted coil spring.

12. The maintenance method of claim 11 wherein the step of outfitting the coil spring with a spring coupler comprises the step of twisting the spring coupler into adjacent coils of said coil spring.

13. The maintenance method of claim 11 wherein the step of tensioning said coil spring comprises the step of directing force into radially opposed coil portions.

14. The maintenance method of claim 13 wherein the step of tensioning said coil spring comprises the step of obliquely directing force into radially opposed coil portions.

* * * * *